US010334375B2

(12) United States Patent
Naether et al.

(10) Patent No.: US 10,334,375 B2
(45) Date of Patent: Jun. 25, 2019

(54) STANDARD ATTACHMENT FOR A STANDARD EARPIECE AND STANDARD EARPIECE

(71) Applicant: SIVANTOS PTE. LTD., Singapore (SG)

(72) Inventors: Thomas Naether, Lemgo (DE); Mareike Schulten, Herford (DE)

(73) Assignee: Sivantos Pte. Ltd., Singapore (SG)

( * ) Notice: Subject to any disclaimer, the term of this patent is extended or adjusted under 35 U.S.C. 154(b) by 1 day.

(21) Appl. No.: 15/604,156

(22) Filed: May 24, 2017

(65) Prior Publication Data

US 2017/0347211 A1 Nov. 30, 2017

(30) Foreign Application Priority Data

May 24, 2016 (DE) ..... 10 2016 208 939

(51) Int. Cl.
*H04R 25/00* (2006.01)

(52) U.S. Cl.
CPC ..... *H04R 25/608* (2013.01); *H04R 25/60* (2013.01); *H04R 25/652* (2013.01); *H04R 25/656* (2013.01); *H04R 25/658* (2013.01); *H04R 2225/021* (2013.01); *H04R 2225/023* (2013.01); *H04R 2225/025* (2013.01); *H04R 2225/63* (2013.01); *H04R 2225/77* (2013.01); *H04R 2460/11* (2013.01)

(58) Field of Classification Search
CPC .... H04R 25/608; H04R 25/60; H04R 25/652; H04R 25/656; H04R 25/658; H04R 2225/021; H04R 2225/023; H04R 2225/025; H04R 2225/63; H04R 2225/77; H04R 2460/11; H04R 2460/15
USPC ..... 381/322, 328, 330
See application file for complete search history.

(56) References Cited

U.S. PATENT DOCUMENTS

| | | | |
|---|---|---|---|
| 5,002,151 | A | 3/1991 | Oliveira et al. |
| 8,175,308 | B2 | 5/2012 | Olsen et al. |
| 8,199,952 | B2 | 6/2012 | Boltyenkov et al. |
| 8,411,890 | B2 | 4/2013 | Doi |
| 2002/0027996 | A1 | 3/2002 | Leedom et al. |
| 2016/0066110 | A1 | 3/2016 | Shennib et al. |

FOREIGN PATENT DOCUMENTS

| | | | |
|---|---|---|---|
| CN | 101138273 | A | 3/2008 |
| DE | 102010022324 | A1 | 12/2011 |
| EP | 2107832 | A2 | 10/2009 |

*Primary Examiner* — Phylesha Dabney
(74) *Attorney, Agent, or Firm* — Laurence A. Greenberg; Werner H. Stemer; Ralph E. Locher

(57) ABSTRACT

A standard attachment for a standard earpiece insertable into an ear canal in a direction of insertion, by which, compared to customary attachments, an improved adaptation of the corresponding standard earpiece to an ear canal is achieved, and therefore improved audio perception, and also improved wearing comfort of the respective hearing aid is ensured. The standard attachment contains a headpiece at one end and, adjoining the latter, a wing portion. The outer contour of the headpiece is configured to allow the headpiece to bear on the wall of the ear canal at several points or on several lines.

11 Claims, 2 Drawing Sheets

STANDARD ATTACHMENT FOR A STANDARD EARPIECE AND STANDARD EARPIECE

CROSS-REFERENCE TO RELATED APPLICATION

This application claims the priority, under 35 U.S.C. § 119, of German application DE 10 2016 208 939.0, filed May 24, 2016; the prior application is herewith incorporated by reference in its entirety.

BACKGROUND OF THE INVENTION

Field of the Invention

The invention relates to a standard attachment for a standard earpiece insertable into an ear canal in a direction of insertion. The invention further relates to a standard earpiece with a corresponding standard attachment.

Many people across the world are affected by hearing loss and impaired hearing. The reduction or the loss of one's ability to hear has a negative impact on communication and contact with others. Therefore, most people affected by hearing loss wear hearing aids, which allow users with impaired hearing to perceive sounds almost normally.

To meet the many individual requirements of hearing aid wearers, different designs of hearing aids are offered. In the case of behind-the-ear (BTE) hearing aids, a housing that contains components such as a battery and the signal processing unit is worn behind the ear. A flexible sound tube guides the acoustic output signals of the receiver from the housing to the auditory canal. Receiver-in-canal (RIC) hearing aids are BTE hearing aids with an electrical connection to a loudspeaker worn in the ear. In the case of so-called in-the-ear (ITE) hearing aids, a housing that contains all the functional components, including the microphone and the loudspeaker, is worn at least partly in the auditory canal. Completely-in-canal (CIC) hearing aids are similar to the ITE hearing aids, but are worn completely in the auditory canal.

Irrespective of the design, it is possible to make use of standardized hearing systems, so-called instant-fit hearing systems. Such instant-fit hearing systems are configured so that they can be used as universally as possible and include standard earpieces which are small enough to be able to be placed in the ear canal of the wearer irrespective of the particular anatomy. However, if the person wearing the hearing aid has a relatively large auditory canal, such standard earpieces often have an insufficient hold in the auditory canal since they are not adapted to the individual ear canal or auditory canal of the person wearing the hearing aid. The earpieces easily slip out of position.

By contrast, if the standard earpiece is too large, the audio perception is often adversely affected, since in this case the ventilation needed to provide pressure equalization in the ear cannot always be ensured. Correspondingly poor ventilation promotes unpleasant feedback effects (occlusion effects). In addition, on account of the hard material of the housing, standard earpieces are often considered uncomfortable by the person wearing the hearing aid.

In order to adapt the standard earpieces to the ear canal of a specific hearing aid wearer, so-called domes made of a plastic material can be used. On account of their soft edges, the domes adapt tightly to the auditory canal or ear canal. This can lead to irritation of the affected skin areas with itching and reddening. By tightly sealing the auditory canal, domes also tend to cause occlusion. For these reasons, some hearing aid wearers prefer not to use domes. Moreover, standard domes are of limited use when it comes to large auditory canals, since the hold in the ear canal is not then ensured. In this case, double domes have to be used.

The use of ear molds is possible as an alternative to domes. Ear molds are attachments which are produced individually for the specific hearing aid wearer by taking an impression of the ear. However, ear molds are not optimized for standard hearing systems or standard earpieces and therefore do not achieve a good fit in the ear. For this reason, the individual impression has to be further processed and optimized using computer-aided manufacturing (CAM) systems. Moreover, when using ear molds with standardized earpieces, there is often the problem of the ear mold pressing against the canal, thereby generating occlusion effects, or of the ear mold sitting too loosely in the canal, with the danger of falling out.

Published, European patent application EP 2 107 832 A2 and U.S. Pat. No. 8,411,890 A1 disclose further attachments for earpieces. In terms of their geometry, the attachments are designed as traditional domes, which each have a number of openings in their outer circumference. These openings permit ventilation of the ear. However, on account of the geometry of the dome, there is also the problem here of non-optimal wearing comfort and of undesired occlusion effects.

Thus, despite the standard earpieces available in different sizes and geometries, and despite the corresponding attachments, it has hitherto not always been possible to take sufficient account of the anatomy of the auditory canal of a particular hearing aid wearer.

SUMMARY OF THE INVENTION

A first object of the invention is to show how it is possible to use a standard earpiece while being able to achieve optimal audio perception and a comfortable fit of the respective hearing aid.

A second object of the invention is to make available a corresponding standard earpiece having improved wearing properties and improved hearing comfort.

The first object of the invention is achieved, according to the invention, by a standard attachment for a standard earpiece insertable into an ear canal in a direction of insertion, wherein the standard attachment contains a headpiece at one end and, adjoining the latter, a wing portion, wherein the outer contour of the headpiece is configured to allow the headpiece to bear on the wall of the ear canal at several points or on several lines.

In a first step, the invention proceeds from the fact that problems with adaptation to the ear canal still arise at present in the case of standardized earpieces and the corresponding attachments. In particular, in view of the fact that adequate solutions have not hitherto been available for all sizes of auditory canal, an optimal fit of the respective earpiece has been sought at the cost of accepting some occlusion effects. Alternatively, it is deliberately sought to avoid occlusion effects, in which case the fit and hold of the earpiece in the ear is of secondary importance. In other words, with the current attachments such as domes or ear molds, it is difficult to ensure both optimal wearing comfort and also optimal audio perception, particularly when using a standard earpiece.

The invention now counters this problem by making available a standard attachment whose geometry is modified in relation to attachments of the prior art. The standard attachment disclosed here contains a headpiece at one end and, adjoining the latter, a wing portion, wherein the outer contour of the headpiece is configured to allow the headpiece to bear on the wall of an ear canal at several points or on several lines.

By means of a punctiform or linear bearing of the standard attachment at individual positions along the outer circumference, in particular at three positions in the manner of a "three-point bearing" (seen in cross section), on the wall inside the ear canal, secure positioning of the standard earpiece is ensured, at the same time with minimal contact between the ear canal and the standard attachment. The outer contour of the headpiece at one end is accordingly configured such that the standard attachment bears only at a small number of locations inside the ear canal. The hearing aid wearer is barely aware of the earpiece in the ear, since the degree of wearing comfort is high. By means of a standard attachment with such an outer contour, which is configured both for the best possible fit in the ear canal and also for compatibility with a corresponding standard earpiece, the adaptation rate is significantly improved compared to domes or standard.

In addition, by virtue of the small number of bearing sites and the corresponding small number of bearing surfaces, a maximum degree of openness is achieved, i.e. sufficient ventilation of the ear, and thus a reduction of occlusion effects. While maintaining the same geometry, the standard attachment is preferably available in different sizes for different auditory canal anatomies and combines the advantages of standard domes and ear molds, since it permits immediate adaptation of the earpiece to the ear canal without the need to take an impression of the ear. The attachment is suitable for standardized earpieces, in particular CIC hearing aids, RIC hearing aids or earpieces of a BTE hearing aid.

The basic cross-sectional surface area of the headpiece is advantageously circular or oval, wherein the design of a headpiece with an oval cross-sectional surface area is preferred. In the case of an oval cross-sectional surface area, the fit of the standard attachment and therefore of the standard earpiece inside the usually likewise oval ear canal is particularly good. However, it is possible to depart in detail from a circular or oval cross-sectional surface area, such that irregular cross-sectional surface areas are obtained.

Particularly preferably, a number of grooves extending substantially parallel to the direction of insertion are arranged on the outer circumference of the headpiece, wherein the or each groove on the outer circumference of the headpiece extends at least as far as the wing portion. By means of the grooves, the outer contour of the headpiece is modified, and the number of possible bearing sites of the standard earpiece and of the standard attachment is reduced to the outer circumference of the headpiece remaining between the grooves.

The headpiece preferably contains several grooves, which are distributed uniformly along its outer circumference. In this way, the hold of the standard earpiece inside the ear canal is further improved. The standard attachment can preferably be used both for the left ear and also for the right ear.

The several grooves along the circumference of the headpiece are expediently spaced apart from each other by webs extending substantially parallel to the direction of insertion. The outer contour of the webs is thus configured to allow the headpiece to bear at several points or several lines on the wall of an ear canal. In other words, possible bearing sites of the headpiece on or inside the ear canal are reduced to the outer contours of the webs. Linear bearing sites in relation to the ear canal are each obtained along the outer contours approximately parallel to the direction of insertion.

Four grooves and four webs are advantageously arranged along the outer circumference of the headpiece, such that a substantially X-shaped cross-sectional surface area of the headpiece is obtained. A substantially X-shaped design provides a small bearing surface while at the same time permitting a secure hold in the ear.

The outer contour of each web preferably forms a portion of a circular trajectory. The outer contour of each web is thus rounded. Depending on the design of the standard earpiece, the outer contours of the webs can either lie on a common circular trajectory or can each form a portion of their own circular trajectory. In the case of an X-shaped cross-sectional surface area, the outer contours of the webs preferably each form a portion of their own circular trajectory. The diameter of the or each circular trajectory forming the outer contour of a web is expediently smaller than the diameter of the headpiece. This results in the holding surfaces on the outer contour of the webs having an inclination that is advantageous in terms of the hold in the ear canal.

In a particularly preferred embodiment of the invention, the wing portion has a number of openings passing through it from the outside to the inside, wherein each opening is assigned a respective groove, and wherein each groove opens into the respective opening assigned to it. This entails an open configuration of the standard attachment, wherein the grooves, in combination with the openings, are occlusion-reducing design elements which serve to optimize the occlusion behavior. The ventilation of the ear is ensured via these occlusion-reducing design elements.

It is expedient in this connection if the wing portion is dimensioned in such a way that, in the fitted state of the standard attachment, the wing portion is spaced apart circumferentially from the standard earpiece. The circumferential spacing means that a free interior is formed between the inner wall of the wing portion and the outer wall of the standard earpiece. Since this interior of the wing portion is open at the outwardly directed side of the standard attachment, i.e. at the entrance of the ear canal, it constitutes a ventilation volume which permits ventilation, and therefore pressure equalization, in particular via the aforementioned openings. Undesired occlusion effects are avoided.

The cross section of the standard attachment expediently widens counter to the direction of insertion. The headpiece of the standard attachment, directed toward the Eustachian tube in the fitted state of the standard attachment (together with the standard earpiece), thus has a smaller cross section than the wing portion located at the entrance of the ear canal. The cross section of the wing portion widens in particular here.

The standard attachment can expediently be fastened to the standard earpiece via the headpiece or is fastened thereon in the plugged state. For this purpose, the headpiece is preferably configured with a fastening opening for force-fit connection to the standard earpiece. The fastening opening is preferably formed on the insertion-side front face of the standard attachment. A fastening element of the standard earpiece can be inserted into the fastening opening in order to fix both components releasably to each other.

The second object of the invention is achieved, according to the invention, by a standard earpiece with a standard attachment in accordance with the embodiment described above. The force-fit connection is preferably configured a rotatable clip connection.

The standard attachment is plugged onto the standard earpiece. For this purpose, a fastening element formed on the front face of the standard earpiece preferably engages in the fastening opening of the standard attachment. The fastening element is preferably received rotatably in the fastening opening. On account of this rotatable configuration of the clip connection, the standard earpiece together with the standard attachment is suitable both for use in the ear canal of the right ear and also in the ear canal of the left ear.

In principle, any earpiece that is located inside the ear canal of the hearing aid wearer in the inserted state can be used quite generally as the standard earpiece. Particularly preferably, the standard earpiece is configured as a standard completely-in-canal (CIC) hearing aid. The housing of the hearing aid ends in the outer part of the auditory canal and is therefore barely visible or indeed completely invisible from the outside. The standard attachment is placed on the hearing aid in the manner described above and meets the requirements in respect of wearing comfort, secure fit, and ventilation of the ear in equal measure.

The advantages of the preferred embodiments of the standard attachment can be transferred by analogy to corresponding embodiments of the standard earpiece.

Other features which are considered as characteristic for the invention are set forth in the appended claims.

Although the invention is illustrated and described herein as embodied in a standard attachment for a standard earpiece, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
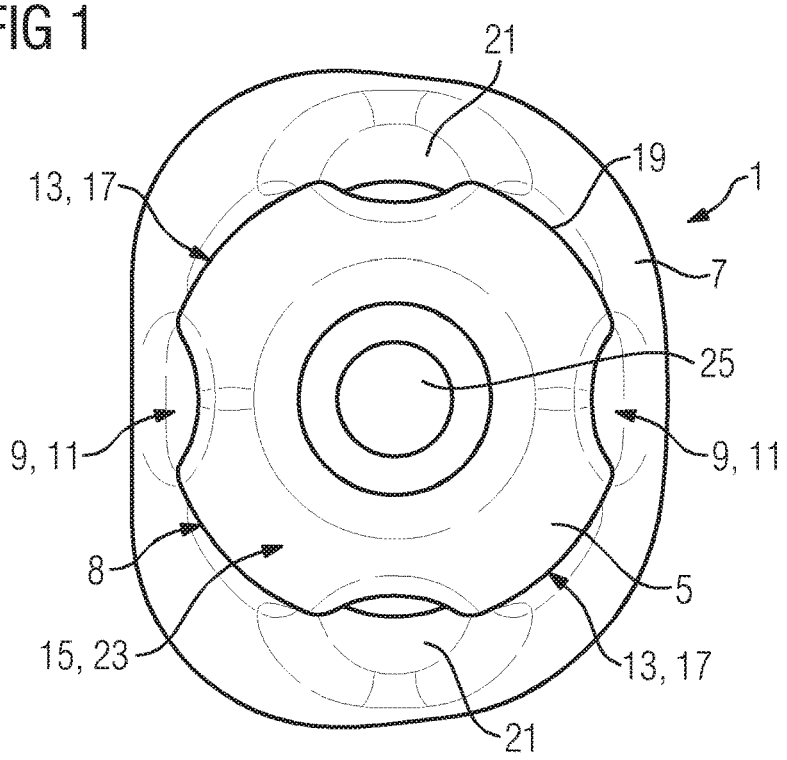
FIG. 1 is a diagrammatic, plan view of a standard attachment according to the invention.
Figure 2:
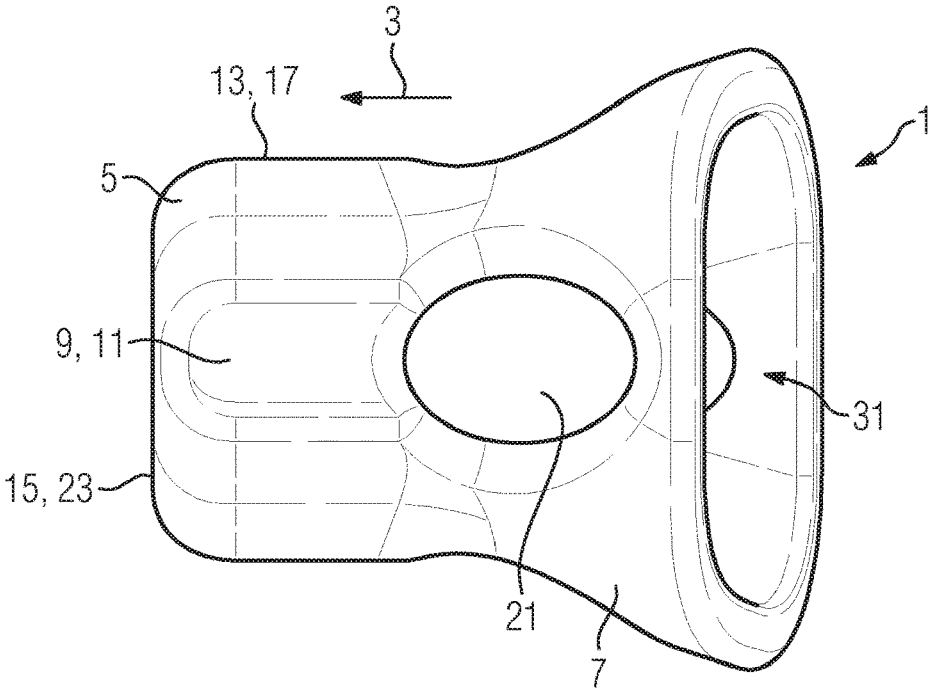
FIG. 2 is a side view of the standard attachment according to FIG. 1.

Referring now to the figures of the drawings in detail and first, particularly to FIG. 1 thereof, there is shown a standard attachment 1. The standard attachment 1 is configured for a standard earpiece (shown in FIG. 3 as a CIC hearing aid 27) which is insertable into an ear canal in a direction of insertion. A direction of insertion 3, which here extends outward from the plane of the paper, is indicated in FIG. 2.

The standard attachment 1 contains a headpiece 5 at one end and, adjoining the latter, a wing portion 7. An outer contour 8 of the headpiece 5 is in this case configured to allow the headpiece 5 to bear along the wall of an ear canal at several points or on several lines. For this purpose, four grooves 11 extending substantially parallel to the direction of insertion 3 are here arranged on the outer circumference 9 of the headpiece 5. The grooves 11 are distributed uniformly along the outer circumference 9 and are spaced apart from each other by webs 13 likewise extending substantially parallel to the direction of insertion 3.

In this way, the headpiece 5 has substantially an X-shaped cross-sectional surface area 15. In the inserted state of the standard attachment 1 (in combination with a standard earpiece), the X-shaped configuration of the cross-sectional surface area 15 offers a comparatively small bearing surface while at the same time providing a secure hold in the ear canal. In this case, the rounded outer contours 17 of the webs 13 each lie on a circular trajectory 19. On account of the normally oval auditory canal, the bearing surfaces on the outer contours 17 of the webs 13 are arranged at approximately 45° to the perpendicular, such that a firm and secure fit can be achieved.

Moreover, in the present case, the wing portion 7 of the standard attachment 1 has four openings 21 passing through it from the outside to the inside. Each of the four openings 21 is assigned to one of the four grooves 11, wherein each groove 11 opens into the respective opening 21 assigned to it.

The standard attachment 1 is configured for optimal adaptation to the inside of an ear canal and is at the same time compatible with a standard earpiece. Standard earpieces of different sizes and also standard attachments 1 can be combined with each other, such that, despite differences in anatomy, an immediate adaptation of the earpiece to an ear canal is possible without taking an impression of the ear.

The standard attachment 1 is fastened to the standard earpiece by a force-fit and rotatable clip connection. For this purpose, a fastening opening 25 is formed on an insertion-side front face 23 of the headpiece 5, and a fastening element of a standard earpiece, for example a spherical head, can engage in the fastening opening 25.

By virtue of the openings 21 and the grooves 11 that open into these, i.e. by virtue of design elements that reduce occlusion, the adaptation of a standard earpiece inside an ear canal is greatly improved by comparison with customary domes or standard ear molds. Occlusion effects, such as occur in the case of ear molds that do not fit correctly and/or in the case of domes, are avoided or at least greatly reduced.

The occlusion-reducing design elements 11, 21 can be seen in FIG. 2. The openings 21 and also the grooves 11 extend substantially parallel to the direction of insertion 3, wherein the grooves 11 are incorporated in the outer circumference 9 of the headpiece 5, and the openings 21 extend through the wing portion 7. In this way, the necessary ventilation of the ear can be ensured when a standard earpiece is fitted in the ear with such a standard attachment 1.

Figure 3:
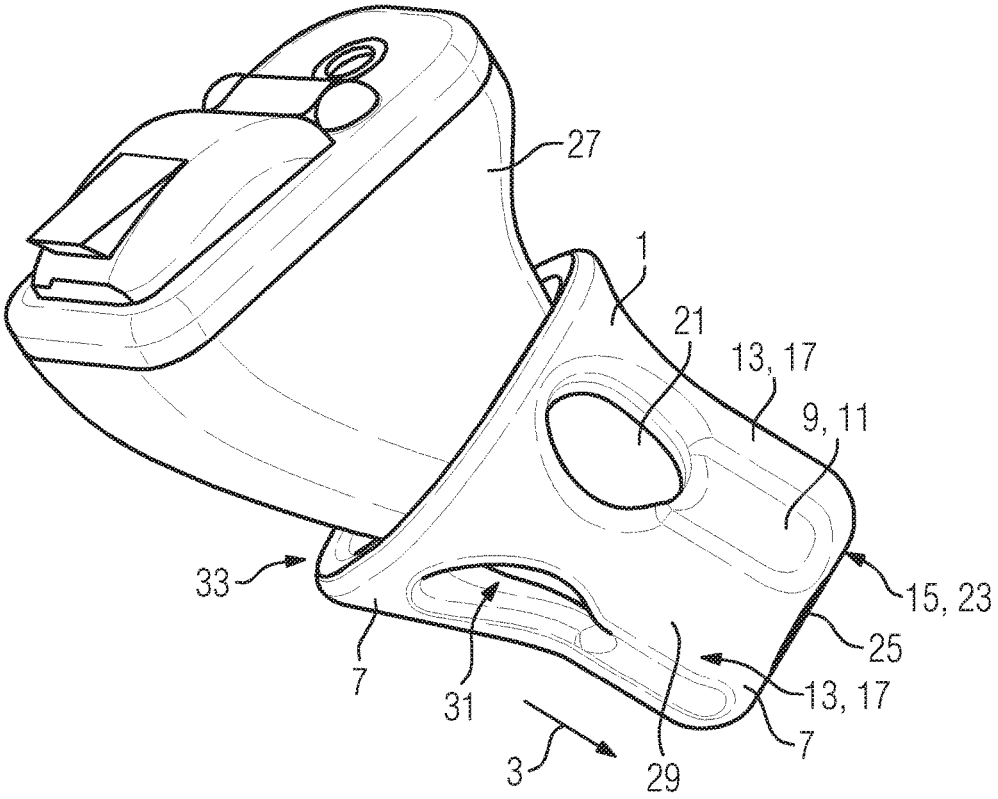
FIG. 3 is a perspective view of the standard attachment according to FIG. 1 and FIG. 2 when mounted on an instant-fit CIC hearing aid.

FIG. 3 shows the standard attachment 1 mounted on a standard earpiece 27 which is configured as an instant-fit CIC hearing aid. As has already been mentioned, both components are fastened to each other by a force-fit and rotatable clip connection. For this purpose, a (symbolized) fastening element 29, for example a spherical head, of the standard earpiece 27 engages in the fastening opening 25 of the standard attachment 1.

The instant-fit CIC hearing aid 27 can be inserted into an ear canal together with the standard attachment 1. For this purpose, both components are pushed jointly into the ear canal in the direction of insertion 3. The standard attachment 1 comes to lie, with a secure hold, at only a small number of linear or punctiform positions along the webs 13 and thus feels comfortable to the person wearing the hearing aid, since he or she scarcely notices they are wearing the standard earpiece 27. As has been described above, the ventilation is provided via the occlusion-reducing design elements 11, 21 of the standard attachment 1.

Moreover, the wing portion 7 is spaced apart circumferentially from the standard earpiece 27, such that an interior 31 within the wing portion 7 is formed between the standard earpiece 27 and the wing portion 7. The interior 31 of the wing portion 7 is open at the outwardly directed side 33 of the standard attachment 1, i.e. at the entrance of the ear canal, and provides a ventilation volume. In combination with the openings 21 and the grooves 11, this ensures the necessary ventilation and, therefore, the pressure equalization.

The following is a summary list of reference numerals and the corresponding structure used in the above description of the invention:

1 standard attachment
3 direction of insertion
5 headpiece
7 wing portion
8 outer contour
9 outer circumference
11 groove
13 web
15 cross-sectional surface area
17 outer contour
19 circular trajectory
21 opening
23 front face
25 fastening opening
2 standard earpiece
29 fastening element
31 interior
33 side

The invention claimed is:

1. A standard attachment for a standard earpiece insertable into an ear canal in a direction of insertion, the standard attachment comprising:

a wing portion; and a headpiece at one end and adjoining said wing portion, said headpiece having an outer contour configured to allow said headpiece to bear on a wall of the ear canal at several points or on several lines, said headpiece having an outer circumference with a number of grooves formed therein and extending substantially parallel to the direction of insertion, and at least one of said grooves on said outer circumference of said headpiece extending at least as far as said wing portion;

said wing portion having a number of openings formed therein and passing through said wing portion from an outside to an inside, each of said openings being assigned a respective one of said grooves, and each of said grooves opening into a respective one of said openings assigned to said groove.

2. The standard attachment according to claim 1, wherein said grooves of said headpiece are distributed uniformly along said outer circumference.

3. The standard attachment according to claim 2, further comprising webs, said grooves along said outer circumference of said headpiece are spaced apart from each other by said webs extending substantially parallel to the direction of insertion.

4. The standard attachment according to claim 3, wherein four of said grooves and four of said webs are disposed along said outer circumference of said headpiece, such that a substantially X-shaped cross section of said headpiece is obtained.

5. The standard attachment according to claim 3, wherein said webs each have an outer contour, and said outer contour of each of said webs forms a portion of a circular trajectory.

6. The standard attachment according to claim 1, wherein said wing portion is dimensioned in such a way that, in a fitted state, said wing portion is spaced apart circumferentially from the standard earpiece.

7. The standard attachment according to claim 1, wherein said wing portion has a cross section which widens counter to the direction of insertion.

8. The standard attachment according to claim 1, wherein said headpiece has a fastening opening formed therein for a force-fit connection to the standard earpiece.

9. A standard earpiece insertable into an ear canal in a direction of insertion, the standard earpiece comprising:

a standard attachment having a wing portion and a headpiece at one end and adjoining said wing portion, said headpiece having an outer contour configured to allow said headpiece to bear on a wall of the ear canal at several points or on several lines, said headpiece having an outer circumference with a number of grooves formed therein and extending substantially parallel to the direction of insertion, and at least one of said grooves on said outer circumference of said headpiece extending at least as far as said wing portion;

said wing portion having a number of openings formed therein and passing through said wing portion from an outside to an inside, each of said openings being assigned a respective one of said grooves, and each of said grooves opening into a respective one of said openings assigned to said groove; and a standard earpiece body connected to said standard attachment.

10. The standard earpiece according to claim 9, wherein said headpiece has a fastening opening formed therein for a force-fit connection to said standard earpiece body, said force-fit connection is configured as a rotatable clip connection.

11. The standard earpiece according to claim 9, wherein the standard earpiece is configured as a standard completely-in-canal hearing aid.

* * * * *